US009699563B2

(12) United States Patent
Faller et al.

(10) Patent No.: US 9,699,563 B2
(45) Date of Patent: Jul. 4, 2017

(54) METHOD FOR RENDERING A STEREO SIGNAL

(71) Applicant: Huawei Technologies Co., Ltd., Shenzhen, Guangdong (CN)

(72) Inventors: Christof Faller, Uster (CH); David Virette, Munich (DE); Yue Lang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 1 day.

(21) Appl. No.: 14/820,143

(22) Filed: Aug. 6, 2015

(65) Prior Publication Data

US 2016/0037260 A1 Feb. 4, 2016

Related U.S. Application Data

(63) Continuation of application No. PCT/EP2013/052327, filed on Feb. 6, 2013.

(51) Int. Cl.
*H04R 5/02* (2006.01)
*H04R 5/04* (2006.01)
(Continued)

(52) U.S. Cl.
CPC ..... *H04R 5/04* (2013.01); *H04S 1/007* (2013.01); *H04S 7/303* (2013.01);
(Continued)

(58) Field of Classification Search
CPC ..... H04R 5/04; H04R 2205/021; H04R 2499/11; H04S 1/007; H04S 7/303; H04S 2420/03
(Continued)

(56) References Cited

U.S. PATENT DOCUMENTS 5,208,493 A 5/1993 Lendaro et al.
5,995,631 A * 11/1999 Kamada ..... H04S 1/002 381/1
(Continued)

FOREIGN PATENT DOCUMENTS

JP 09168200 A 6/1997
WO WO 2007/004147 A2 1/2007
WO WO 2013/040738 A1 3/2013

OTHER PUBLICATIONS

Harry F. Olson, "Gradient Microphones", The Journal of the Acoustical Society of America, vol. 17, No. 3, Jan. 1946, p. 192-198.
(Continued)

*Primary Examiner* — Vivian Chin
*Assistant Examiner* — Douglas Suthers

(57) ABSTRACT

The invention relates to a method for rendering a stereo audio signal over a first loudspeaker and a second loudspeaker with respect to a desired direction, the stereo audio signal comprising a first audio signal component (L) and a second audio signal component (R), the method comprising: providing a first rendering signal based on a combination of L and a first difference signal obtained based on a difference between L and R to the first loudspeaker, and providing a second rendering signal based on a combination of R and a second difference signal obtained based on the difference between L and R to the second loudspeaker, such that both difference signals are different with respect to sign and one difference signal is delayed by a delay compared to the other difference signal to define a dipole signal, wherein the delay is adapted according to the desired direction.

16 Claims, 9 Drawing Sheets

(51) Int. Cl.
*H04S 1/00* (2006.01)
*H04S 7/00* (2006.01)

(52) U.S. Cl.
CPC .... *H04R 2205/021* (2013.01); *H04R 2499/11* (2013.01); *H04S 2420/03* (2013.01)

(58) Field of Classification Search
USPC ..... 381/303, 310
See application file for complete search history.

(56) References Cited

U.S. PATENT DOCUMENTS

| | | | |
|---|---|---|---|
| 6,507,657 | B1 | 1/2003 | Kamada et al. |
| 2005/0152554 | A1 | 7/2005 | Wu |
| 2007/0025555 | A1 | 2/2007 | Gonai et al. |

OTHER PUBLICATIONS

Frank Baumgarte, et al., "Binaural Cue Coding—Part I: Psychoacoustic Fundamentals and Design Principles", IEEE Transactions on Speech and Audio Processing, vol. 11, No. 6, Nov. 2003, p. 509-519.
Christof Faller, et al., "Binaural Cue Coding—Part II: Schemes and Applications", IEEE Transactions on Speech and Audio Processing, vol. 11, No. 6, Nov. 2003, p. 520-531.
Christof Faller, "Parametric Coding of Spatial Audio", These No. 3062, 2004, 180 pages.
Fr. Heegaard, "The Reproduction of Sound in Auditory Perspective and a Compatible System of Stereophony", J. Audio Eng. Soc., vol. 40, No. 10, Oct. 1992, p. 802-808.

* cited by examiner

METHOD FOR RENDERING A STEREO SIGNAL

CROSS-REFERENCE TO RELATED APPLICATIONS

This application is a continuation of International Application No. PCT/EP2013/052327, filed on Feb. 6, 2013, which is hereby incorporated by reference in its entirety.

TECHNICAL FIELD

The present invention relates to a method for rendering a stereo signal over a first and a second loudspeaker with respect to a desired direction and to a mobile device for rendering a stereo signal.

In particular, the invention relates to the field of sound reproduction by using loudspeaker systems.

BACKGROUND

There are many portable devices with two loudspeakers on the market, such as iPod docks or laptops. Tablets and mobile phones with built-in stereo loudspeakers can be viewed as stereo portable devices. Compared to a conventional stereo system with two discrete loudspeakers, the two loudspeakers of a portable stereo device are located very close to each other. Due to the size of the device, they are usually spaced by only few centimeters, between 10 and 30 cm for mobile devices such as smartphones or tablets. This results in music reproduction which is narrow, almost "mono-like".

The concept of Mid/Side loudspeaker has been introduced in (Heegaard, F. D. (1992). "The Reproduction of Sound in Auditory Perspective and a Compatible System of Stereophony", J. Audio Eng. Soc., 40(10), pp. 802-808). The goal was to reproduce a stereo signal with only a single loudspeaker box. As opposed to playing back left and right signals, sum signal, i.e. left signal plus right signal and difference signal, i.e. left signal minus right signal are reproduced with two loudspeakers with different characteristics. The sum signal is played back with a conventional loudspeaker which is omnidirectional at low frequencies and unidirectional at high frequencies. The difference signal is reproduced with a dipole loudspeaker, bi-directionally pointing towards left and right directions. Perceptually, this results in that a listener hears the sum signal (soloists, main content) from the loudspeaker position. Additionally, there is a spatial effect. The dipole, driven with the difference signal, excites the room with zero sound propagation towards the listener.

In the patent application PCT/CN2011/079806, a method for generating an acoustic signal with enhanced spatial effect is described. This method uses the same principle of dipole rendering, applied with normal loudspeaker systems. The original stereo signal is played out on the two loudspeakers and the difference signal is played out with a dipole rendering from the same loudspeaker system, i.e. direct rendering on one side, and multiplied by −1 on the other side. Such a system, however, requires that the listener is in a central listening position. If the listener is not exactly located in front of the loudspeaker system, his sound impression exhibits a sustained decline.

SUMMARY

It is the object of the invention to provide an improved technique for reproducing a stereo signal.

This object is achieved by the features of the independent claims. Further implementation forms are apparent from the dependent claims, the description and the figures.

The invention is based on the finding that changing the rendering of difference and spatial signals reproduced with dipole characteristics according to the position of the listener allows steering zero sound propagation of the different/spatial signal towards the listener thereby improving his sound impression. By applying that technique, the invention does not require that the listener is located in a central listening position.

In order to describe the invention in detail, the following terms, abbreviations and notations will be used:

L: left channel, left path, left path signal component,
R: right channel, right path, right path signal component,
BCC: Binaural Cue Coding,
CLD: Channel Level Difference
ILD: Inter-channel Level Difference,
ITD: Inter-channel Time Differences,
IPD: Inter-channel Phase Differences,
ICC: Inter-channel Coherence/Cross Correlation,
STFT: Short-Time Fourier Transform,
QMF: Quadrature Mirror Filter.

According to a first aspect, the invention relates to a method for rendering a stereo audio signal over a first loudspeaker and a second loudspeaker with respect to a desired direction, the stereo signal comprising a first audio signal component and a second audio signal component, the method comprising: providing a first rendering signal based on a combination of the first audio signal component and a first difference signal obtained based on a difference between the first audio signal component and the second audio signal component to the first loudspeaker, and providing a second rendering signal based on a combination of the second audio signal component and a second difference signal obtained based on the difference between the first audio signal component and the second audio signal component to the second loudspeaker, such that both difference signals are different with respect to sign and one difference signal is delayed by a delay compared to the other difference signal to define a dipole signal, wherein the delay is adapted according to the desired direction.

The first and second audio signal component may be a first and a second audio channel signal of a conventional stereo signal or spatial cues and a downmix signal of a parametric stereo signal, e.g. first and second spatial cues for left and right channel per sub-band. Spatial cues are inter-channel cues. The loudspeakers may be conventional loudspeakers, i.e. no dipole loudspeaker hardware is required.

The method allows providing a stereo rendering with enhanced spatial perception steering to a desired direction, e.g. a direction where a listener is positioned and thus provides an improved technique for reproducing a stereo signal.

In a first possible implementation form of the method according to the first aspect, the method comprises adapting the delay as a function of an angle defining the desired direction relative to a central position with regard to the two loudspeakers.

The central position denotes a zero degree angle or a central line between the two loudspeakers.

By adapting the delay as a function of the angle with respect to the desired direction an optimum sound impression can be provided to the listener.

In a second possible implementation form of the method according to the first implementation form of the first aspect, the method comprises adapting the delay as a function of a distance between the loudspeakers.

By adapting the delay as a function of a distance between the loudspeakers, the method can be applied for each kind of mobile device no matter where and in which distance the loudspeakers are arranged. Even for external loudspeakers optimum sound quality can be guaranteed to the listener.

In a third possible implementation form of the method according to the first implementation form or according to the second implementation form of the first aspect, the function of the angle is according to: $u=\cos(\pi/2+\alpha)/(\cos(\pi/2+\alpha)-1)$, where $\alpha$ denotes the angle defining the desired direction relative to a central position with regard to the two loudspeakers and u denotes the function of the angle.

Such a function can be efficiently realized by a lookup table storing the function values with respect to the angle. The computational complexity is low.

In a fourth possible implementation form of the method according to the third implementation form of the first aspect, the method comprises adapting the delay according to: $\tau=ud/(c(1-u))$, where $\tau$ denotes the delay, d denotes the distance between the loudspeakers, u denotes the function of the angle ($\alpha$) defining the desired direction relative to a central position with regard to the two loudspeakers and c denotes the speed of sound propagation.

Such a function can be easily computed as the parameters u, d and c can be predetermined and stored in a lookup table for fixed position of the loudspeakers in the mobile device applying that method. For variable loudspeaker positions, e.g. when using external loudspeakers, the sound-field parameter c and the distance d between the loudspeakers can be re-computed and thus the method is flexible with respect to changes of the loudspeaker positions.

In a fifth possible implementation form of the method according to the first aspect as such or according to any of the preceding implementation forms of the first aspect, the method comprises adapting the delay such that zero sound of the dipole signal is emitted towards the desired direction.

When zero sound is emitted towards the desired direction, e.g. to the direction where the listener is positioned, the spatial impression of the listener is enhanced as he hears the sound arriving from two distinct directions.

In a sixth possible implementation form of the method according to the first aspect as such or according to any of the preceding implementation forms of the first aspect, the method comprises delaying and filtering the difference between the first audio signal component and the second audio signal component prior to the combining with the first and second signal components; wherein further the combination of the first audio signal component and the first difference signal comprises an addition of the first audio signal component and the first difference signal, and the combination of the second audio signal component and the second difference signal comprises an addition of the second audio signal component and the second difference signal.

By delaying and filtering the difference signal prior to the combining with the first and second signal components the low-frequency gain loss of the differential sound reproduction can be compensated.

In a seventh possible implementation form of the method according to the sixth implementation form of the first aspect, the filtering comprises using a low-pass filter.

By using filtering with low-pass shelving filter the spectral shape of reverberation can be mimicked, thereby enhancing the sound impression.

In an eighth possible implementation form of the method according to the first aspect as such or according to any of the preceding implementation forms of the first aspect, the method comprises obtaining a direction information indicating the desired direction; e.g. by sensing a position of a listener; and adapting the delay based on the direction information.

By sensing a position of a listener for determining the desired direction, the method can be adjusted to the listener position and the method is flexibly adjustable to a moving listener. Even more than one listener can be detected and the method can be directed to a desired listener, e.g. a listener in a group of listeners.

In a ninth possible implementation form of the method according to the first aspect as such or according to any of the preceding implementation forms of the first aspect, the distance between the loudspeakers is within a range of 5 cm and 40 cm.

When the distance between the loudspeakers is within a range of 5 cm and 40 cm, the method is adapted to be applied in standard mobile devices such as mobile phones, smartphones, tablets etc.

In a tenth possible implementation form of the method according to the first aspect as such or according to any of the preceding implementation forms of the first aspect, the angle defining the desired direction relative to a central position with regard to the two loudspeakers is within a range of −90 degrees and +90 degrees.

When the angle is within that range, the dipole rendering can be steered in all possible directions in front of a mobile device applying that method. There are no limitations with respect to the position of the listener.

In an eleventh possible implementation form of the method according to the first aspect as such or according to any of the preceding implementation forms of the first aspect, the angle defining the desired direction relative to a central position with regard to the two loudspeakers is outside of a range between −1° and +1°, outside of a range between −5° and +5° or outside of a range between −10° and +10°.

In a twelfth possible implementation form of the method according to the first aspect as such or according to any of the preceding implementation forms of the first aspect, the stereo signal is available in compressed form as a parametric stereo signal comprising a mono down-mix signal and at least one inter-channel cue, in particular one of an inter-channel level difference, an inter-channel time difference, an inter-channel phase difference and an inter-channel coherence/cross correlation.

The method can be applied for multichannel audio signals. Thus, the method can be applied for compressed stereo signals. The method can be embedded in parametric stereo synthesis, thereby decreasing computational complexity.

In a thirteenth possible implementation form of the method according to the twelfth implementation form of the first aspect, the method comprises: determining the difference between the first audio signal component and the second audio signal component in frequency domain on a sub-band basis of the parametric stereo signal; and determining the delay by using a phase shift with respect to the sub-bands of the parametric stereo signal.

The difference corresponds to a difference signal but is not to be mixed up with the first and second difference signals. The parametric stereo signal may be only interchannel (spatial) cues or both, downmix signal and interchannel cues.

Implementing the method in frequency sub-bands saves computational complexity. Synergies can be realized with respect to separate computations of frequency synthesis and rendering steering direction.

In a fourteenth possible implementation form of the method according to the first aspect as such or according to any of the preceding implementation forms of the first aspect, the delay is adapted in a preset manner according to the desired direction.

The adapted delay may be both, an already fixedly adapted delay and a flexibly or dynamically adapted delay. A fixed adapted delay may be an adaptation to a desired direction different from 0° with regard to the central line between the two loudspeakers.

In a fifteenth possible implementation form of the method according to the first aspect as such or according to any of the preceding implementation forms of the first aspect, the method comprises delaying and filtering the difference between the first audio signal component and the second audio signal component prior to the combining with the first and second signal components.

In a sixteenth possible implementation form of the method according to the first aspect as such or according to any of the preceding implementation forms of the first aspect, the combination of the first audio signal component and the first difference signal comprises an addition of the first audio signal component and the first difference signal, and the combination of the second audio signal component and the second difference signal comprises an addition of the second audio signal component and the second difference signal.

In a seventeenth possible implementation form of the method according to the first aspect as such or according to any of the preceding implementation forms of the first aspect, the combination of the first audio signal component and the first difference signal comprises an addition of the first audio signal component and the first difference signal.

In an eighteenth possible implementation form of the method according to the first aspect as such or according to any of the preceding implementation forms of the first aspect, the combination of the second audio signal component and the second difference signal comprises an addition of the second audio signal component and the second difference signal.

According to a second aspect, the invention relates to a mobile device configured for rendering a stereo audio signal over a first loudspeaker and a second loudspeaker with respect to a desired direction, the stereo signal comprising a first audio signal component and a second audio signal component, the mobile device comprising: rendering means configured for providing a first rendering signal based on a combination of the first audio signal component and a first difference signal obtained based on a difference between the first audio signal component and the second audio signal component to the first loudspeaker, and providing a second rendering signal based on a combination of the second audio signal component and a second difference signal obtained based on the difference between the first audio signal component and the second audio signal component to the second loudspeaker, such that both difference signals are different with respect to sign and one difference signal is delayed by a delay compared to the other difference signal to define a dipole signal, wherein the rendering means is configured to adapt the delay according to the desired direction.

The mobile device performs stereo rendering with enhanced spatial perception steering to a desired direction, e.g. a direction where a listener is positioned and thus provides an improved technique for reproducing a stereo signal. The mobile device can also process a parametric representation of a stereo signal, for example a compressed stereo signal or a mono or stereo representation of a multichannel audio signal.

In a first possible implementation form of the mobile device according to the second aspect, the mobile device comprises sensing means, in particular a camera, configured for sensing positioning information of a listener listening to the stereo signal, wherein the rendering means is configured to adapt the delay based on the positioning information.

By sensing positioning information of a listener for determining the desired direction, the mobile device can be adjusted to the listener position and is thus flexibly adjustable to a moving listener. Even more than one listener can be detected and the mobile device can be directed to a desired listener, e.g. a listener in a group of listeners.

In a second possible implementation form of the mobile device according to the second aspect as such or according to the first implementation form of the second aspect, the stereo signal is available in compressed form as a parametric stereo signal comprising a mono down-mix signal and at least one inter-channel cue, in particular one of an inter-channel level difference, an inter-channel time difference, an inter-channel phase difference and an inter-channel coherence/cross correlation.

The mobile device can process multichannel audio signals and compressed stereo signals. The rendering device can be embedded in an entity processing the parametric stereo synthesis, thereby decreasing computational complexity.

In a third possible implementation form of the mobile device according to the second aspect as such or according to any of the preceding implementation forms of the second aspect, the mobile device comprises a first determining entity configured for determining the difference signal in frequency domain on a sub-band basis of the parametric stereo signal; and a second determining entity configured for determining the delay by using a phase shift with respect to the sub-bands of the parametric stereo signal.

Processing frequency sub-bands saves computational complexity. Synergies can be realized with respect to separate computations of frequency synthesis and rendering steering direction.

In a fourth possible implementation form of the mobile device according to the second aspect as such or according to any of the preceding implementation forms of the second aspect, the a first loudspeaker and a second loudspeaker are built-in loudspeakers integrated into the mobile device.

According to a third aspect, the invention relates to a method, comprising: receiving a stereo signal having a left and a right channel; reproducing a sum signal directly with a pair of loudspeakers; reproducing left and/or right difference signals between the left and right channel, and optionally also a reverb signal with the two loudspeakers such that they have a first order directivity pattern, wherein a directivity pattern of the loudspeakers is controlled such that its zero points towards the most likely listener position.

In a first possible implementation form of the method according to the third aspect, the reproducing the sum signal and the reproducing the left and/or right difference signals are combined in order to compute the stereo signal.

In a second possible implementation form of the method according to the third aspect as such or according to the first implementation form of the third aspect, the method comprises playing out the stereo signal by the loudspeakers.

According to a fourth aspect, the invention relates to a method for rendering a stereo signal comprising a left signal and a right signal over two loudspeakers, the method comprising: rendering the stereo signal directly to the loudspeakers; and adding a rendered difference signal, providing this signal with a different sign and delay to both loudspeakers.

In a first possible implementation form of the method according to the fourth aspect, the left signal is rendered on the left loudspeaker and the right signal is rendered on the right loudspeaker.

In a second possible implementation form of the method according to the fourth aspect as such or according to the first implementation foam of the fourth aspect, the method comprises: applying a delay and/or a filter to the difference signal.

In a third possible implementation form of the method according to the fourth aspect as such or according to any of the preceding implementation forms of the fourth aspect, the method comprises: determining the delay as a function of a desired steering direction of the loudspeakers.

In a fourth possible implementation form of the method according to the fourth aspect as such or according to any of the preceding implementation forms of the fourth aspect, the method comprises: obtaining the desired steering direction from sensors of a mobile device.

The methods, systems and devices described herein may be implemented as software in a Digital Signal Processor (DSP), in a micro-controller or in any other side-processor or as hardware circuit within an application specific integrated circuit (ASIC).

The invention can be implemented in digital electronic circuitry, or in computer hardware, firmware, software, or in combinations thereof, e.g. in available hardware of conventional mobile devices or in new hardware dedicated for processing the methods described herein.

BRIEF DESCRIPTION OF THE DRAWINGS

Further embodiments of the invention will be described with respect to the following figures, in which.

DETAILED DESCRIPTION

Figure 1:
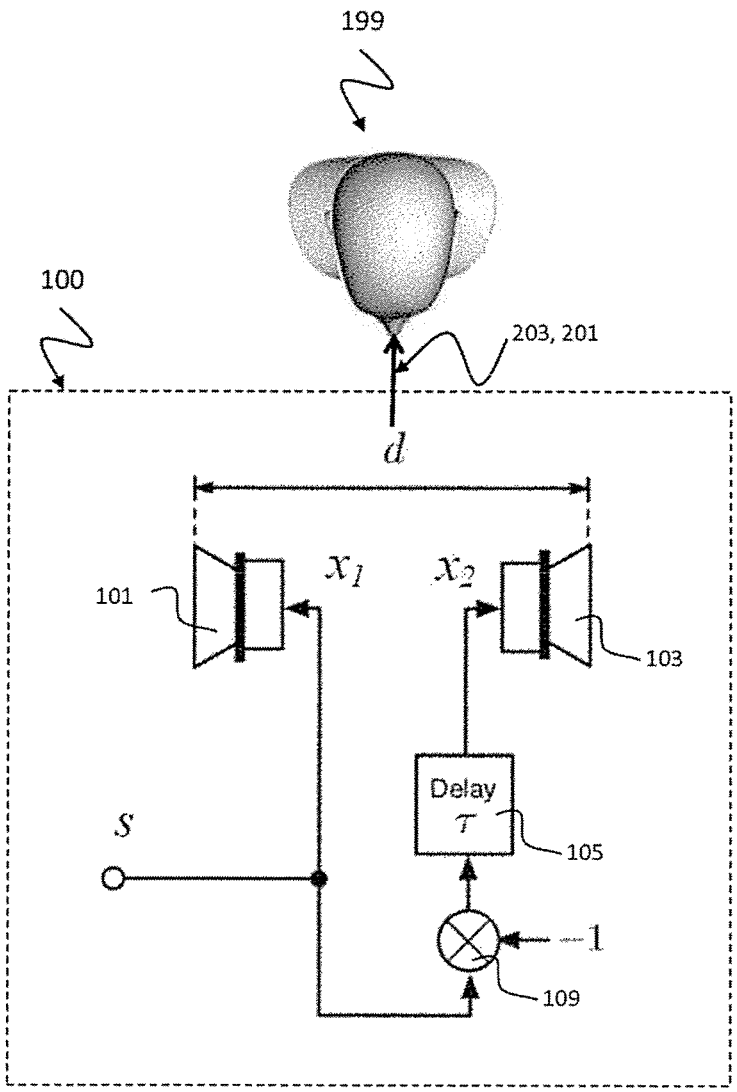
FIG. 1 shows a schematic diagram of a first order differential loudspeaker array 100 according to an implementation form.

FIG. 1 shows a schematic diagram of a first order differential loudspeaker array 100 according to an implementation form. The loudspeaker array 100 comprises a left path loudspeaker 101, a right path loudspeaker 103, a time delay 105 and a signal inverter 109. The loudspeakers 101, 103 are conventional loudspeakers, i.e. no special hardware for implementing dipole loudspeakers is required.

Figure 4:
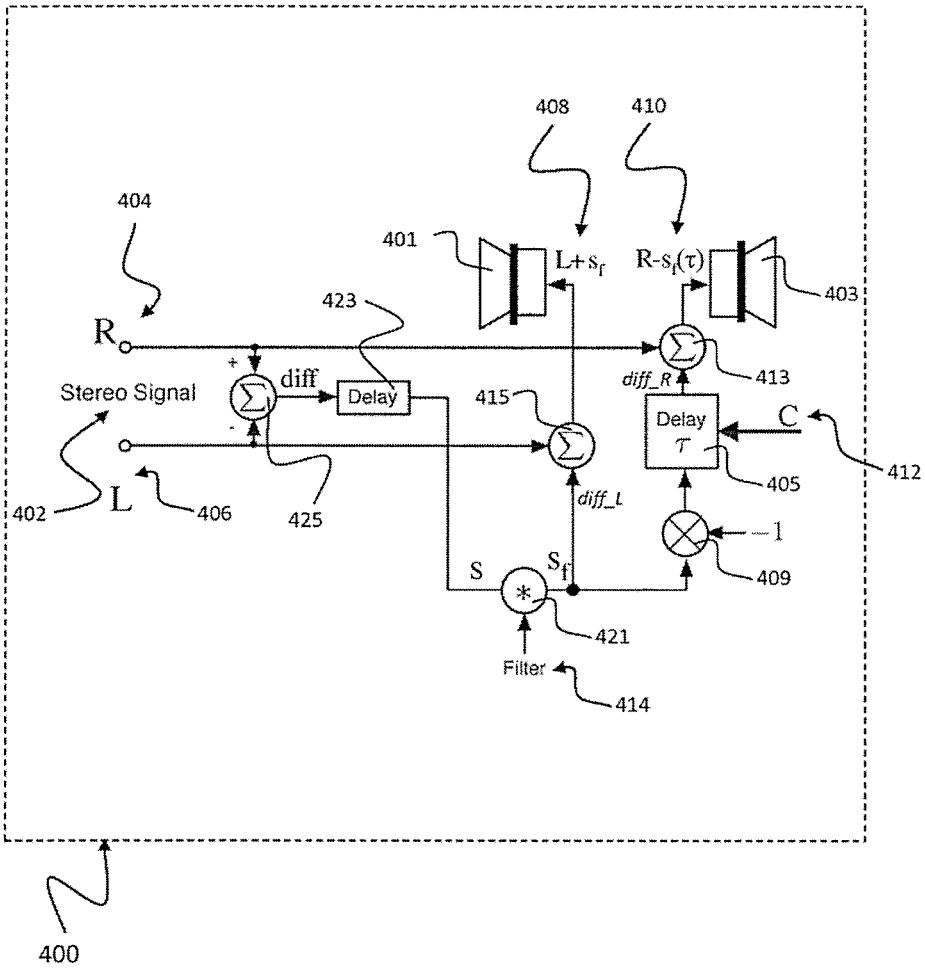
FIG. 4 shows a block diagram of a loudspeaker system 400 according to an implementation form.
Figure 9:
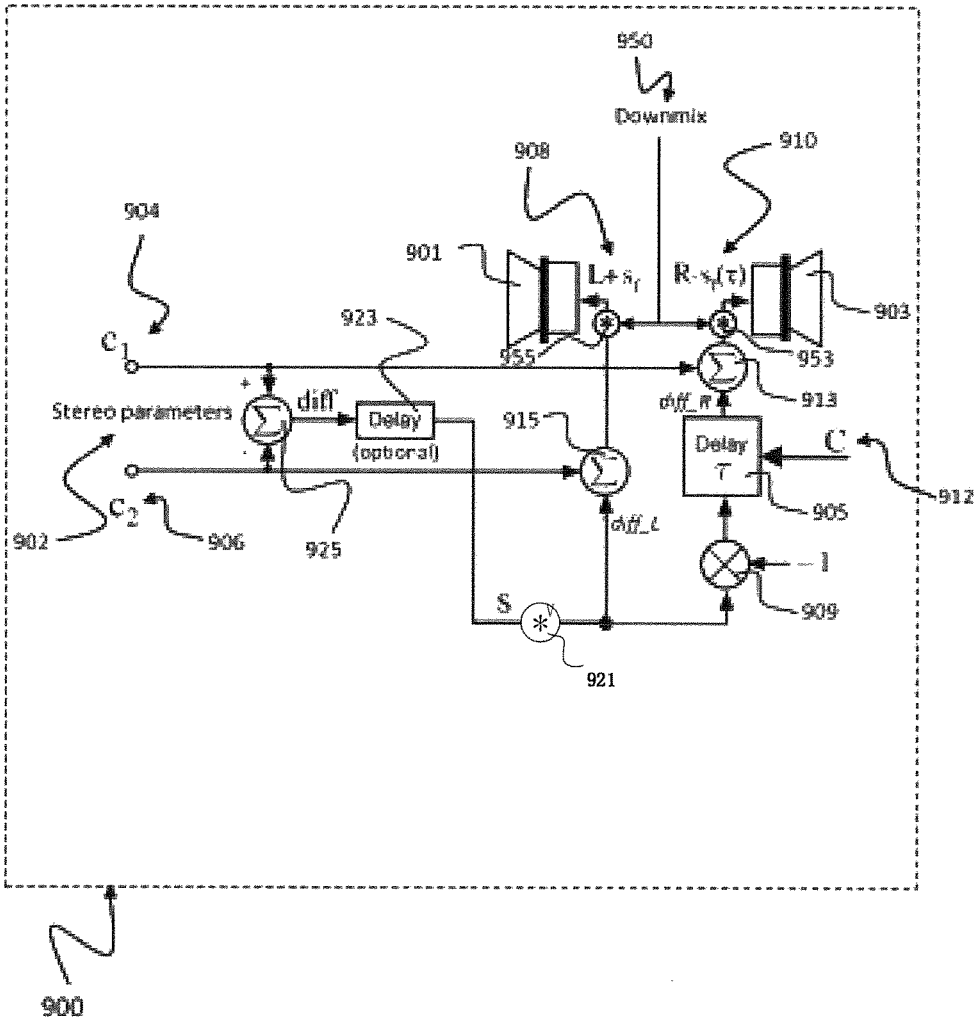
FIG. 9 shows a block diagram of a loudspeaker system 900 according to an implementation form.

As illustrated in FIG. 1, a signal s(t), for example an audio signal, and in particular for example a difference signal diff or delayed difference signal as described later based on FIGS. 4 and 9, is given to one loudspeaker 101, and a corresponding inverted and delayed signal $-s(t-\tau)$ to the other loudspeaker 103. The signal which is used for the dipole rendering is the difference signal computed as left minus right channel signals. The two loudspeakers 101, 103 are driven with the signals $$x_1(t)=s(t)$$

$$x_2(t)=-s(t-\tau). \tag{1}$$

The sound field generated by such a pair of point-source modeled loudspeakers 101, 103 in the far-field is $$p(r,t)=2j\sin(\omega/2c(c\tau+d\cos\phi))(s(t-\tau/c-\tau/2)/r). \tag{2}$$

At low frequencies, (2) can be approximated by $$\begin{aligned} p(r,t) &\approx j\omega(\tau+d/c\cos\varphi)\ (s(t-r/c-\tau/2)/r) \\ &\approx j\omega(c\tau+d)/c\ (u+(1-u)\cos\varphi\ (s(t-r)/c-\tau/2)/r), \end{aligned} \tag{3}$$

wherefrom it can be seen that the ratio $c\tau/(c\tau+d)$ corresponds to a parameter, determining the directional response shape $$\text{directivity}(\phi)=u+(1-u)\cos\phi. \tag{4}$$

The parameter d in equations (2) and (3) represents the distance between the loudspeakers 101, 103 as depicted in FIG. 1. In a preferred implementation, this distance is rather small and compatible with mobile device applications. It is then in the range of 5 to 40 cm.

The parameter u, which steers a zero towards an angle $\alpha$ ([0, $\pi/2$]) with respect to a direction 201 of a listener 199 is as follows:

$$u=\cos(\pi/2+\alpha)/(\cos(\pi/2+\alpha)-1). \tag{5}$$

Figure 2:
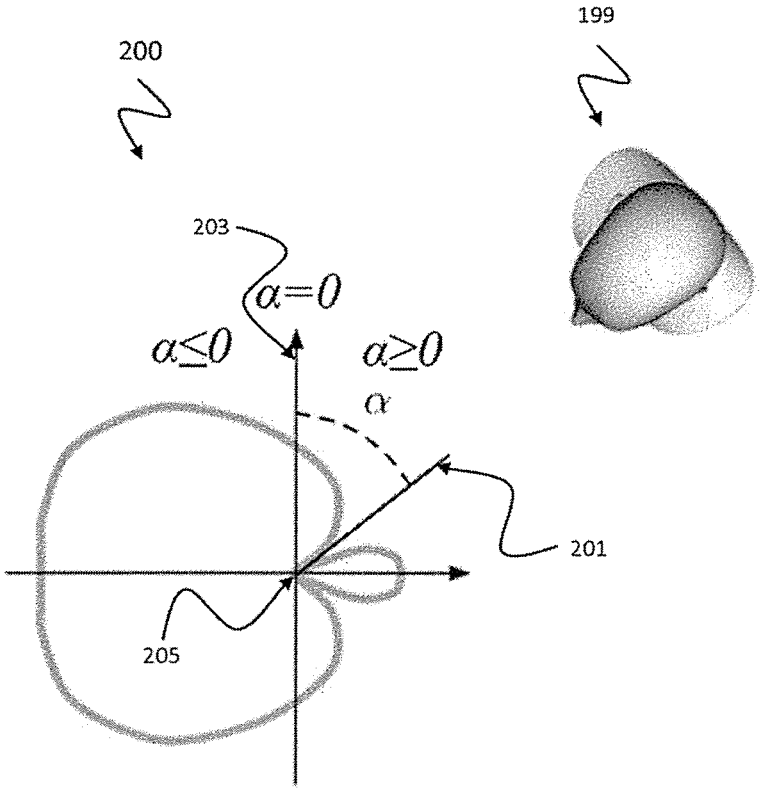
FIG. 2 shows a schematic diagram of a directional response 200 with zero direction of the differential loudspeaker array 100 depicted in FIG. 1.

As can be seen from FIG. 2, the angle $\alpha$ is defined with respect to a centerline direction 203 also called zero direction 203 of the loudspeaker pair 101, 103. FIG. 2 shows a schematic diagram of a directional response 200 with zero direction 203 of the differential loudspeaker array 100 depicted in FIG. 1. $\alpha$ is formed by the angle between the centerline direction 203 of the loudspeaker pair 101, 103 and the direction 201 where the listener 199 is positioned with respect to a center 205 of the loudspeaker array 100. If the listener 199 is positioned in centerline direction 203, i.e. the centerline direction 203 coincides with the direction 201 of the listener 199 as shown in FIG. 1, the angle $\alpha$ is zero. If the listener 199 is positioned right from the centerline direction 203, i.e. towards the right loudspeaker 103 in listener direction 201 as shown in FIG. 2, the angle $\alpha$ is positive. If the listener 199 is positioned left from the centerline direction 203, i.e. towards the left loudspeaker 101 not shown in FIG. 2, the angle $\alpha$ is negative.

Figure 3:
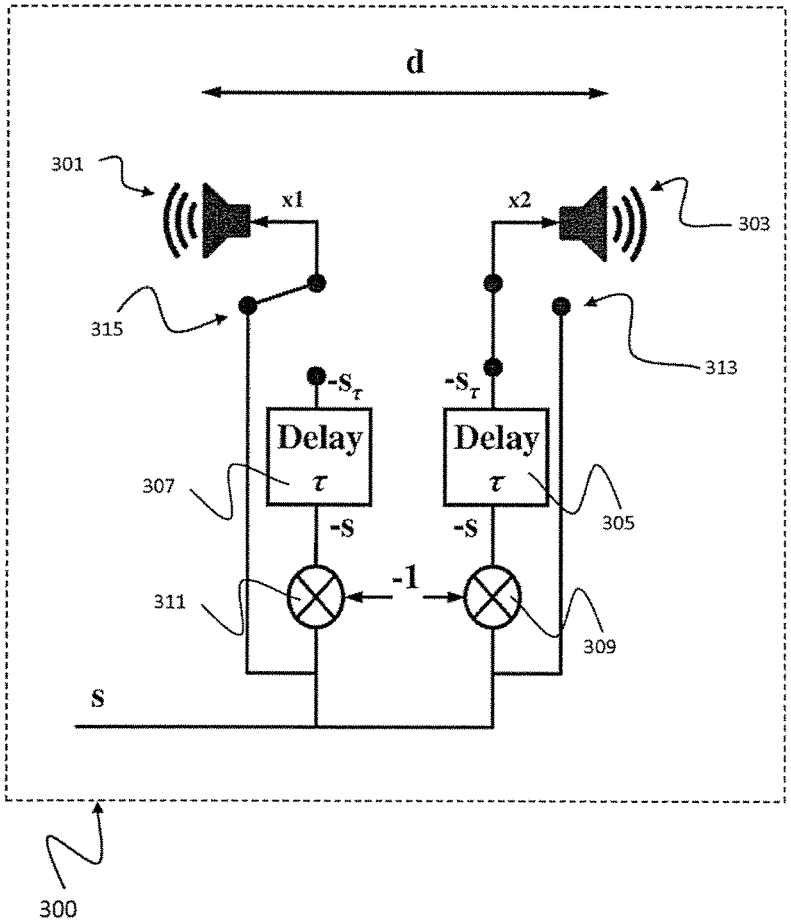
FIG. 3 shows a block diagram of a loudspeaker system 300 according to an implementation form.

For negative angles $\alpha[-\pi/2, 0]$, the delay and the inversion are applied to the other loudspeaker, i.e. the left loudspeaker 103 of FIG. 1 as illustrated in FIG. 3 described below and u (5) is computed for $|\alpha|$. The delay $\tau$, corresponding to this u is $\tau=ud/(c(1-u))$.

FIG. 3 shows a block diagram of a loudspeaker system 300 according to an implementation form. The loudspeaker system 300 can adapt the dipole rendering steering in the direction indicated by $\alpha$ in the range $[-\eta/2; \pi/2]$, i.e. in directions left from the zero direction 203 and right from the zero direction 203 depicted in FIG. 3.

The loudspeaker system 300 comprises a left path loudspeaker 301, a right path loudspeaker 303, a left path time delay 307, a right path time delay 305, a left path signal inverter 311, a right path signal inverter 309, a left path switch 315 and a right path switch 313. The loudspeakers 301, 303 are conventional loudspeakers, i.e. no special hardware for implementing dipole loudspeakers is required.

As illustrated in FIG. 3, an audio signal s(t), for example a difference signal diff or delayed difference signal as described later based on FIGS. 4 and 9, is given to one loudspeaker 301, and a corresponding inverted and delayed audio signal $-s(t-\tau)$ to the other loudspeaker 303. Depending on the position of the switches 315 and 313 the audio signal s(t) is given to the left path loudspeaker 301 and the inverted and delayed audio signal $-s(t-\tau)$ is given to the right path loudspeaker 303 or the audio signal s(t) is given to the right path loudspeaker 303 and the inverted and delayed audio signal $-s(t-\tau)$ is given to the left path loudspeaker 301. In a first position of the switches 315, 313 as shown by FIG. 3, when the left path switch 315 directly couples the audio signal s(t) to the left path loudspeaker 301 without passing the left path signal delay 307 and the left path signal inverter 311 and the right path switch 313 couples the audio signal s(t) via the right path signal inverter 309 and the right path signal delay 305 to the right path loudspeaker 303, the audio signal s(t) is given to the left path loudspeaker 301 and the inverted and delayed audio signal $-s(t-\tau)$ is given to the right path loudspeaker 303. In the first position of the switches 313, 315 the angle $\alpha$ is in the range $[\pi/2; 0]$. In a second position of the switches 315, 313 not shown by FIG. 3, when the right path switch 313 directly couples the audio signal s(t) to the right path loudspeaker 303 without passing the right path delay 305 and the right path signal inverter 309 and the left path switch 315 couples the audio signal s(t) via the left path signal delay 307 and the left path signal inverter 311 to the left path loudspeaker 301, the audio signal s(t) is given to the right path loudspeaker 303 and the inverted and delayed audio signal $-s(t-\tau)$ is given to the left path loudspeaker 301. In the second position of the switches 313, 315 the angle $\alpha$ is in the range $[0; -\pi/2]$. This second position of the switches 313, 315 corresponds to the configuration as described above with respect to FIG. 1 and FIG. 2.

FIG. 4 shows a block diagram of a loudspeaker system 400 according to an implementation form.

The loudspeaker system 400 comprises a left path loudspeaker 401, a right path loudspeaker 403, a right path time delay 405, a right path signal inverter 409, a right path summer 413, a left path summer 415, a difference path summer 425, a difference path time delay 423 and a difference path multiplier 421. The loudspeakers 401, 403 are conventional loudspeakers, i.e. no special hardware for implementing dipole loudspeakers is required.

As illustrated in FIG. 4, a stereo audio signal 402 with left channel signal component L 406, e.g. a left channel audio signal, and right channel signal component R 404, e.g. a right channel audio signal, is input to the loudspeaker system 400. The right channel signal component R 404 is given to the right path summer 413 and to the difference path summer 425, the left channel signal component L 406 is given to the left path summer 415 and the inverted left channel signal component L 406 is given to the difference path summer 425. The difference path summer 425 subtracts the left channel signal component L 406 from the right channel signal component R 404 providing a difference signal diff to the difference path time delay 423. The output signal s of the difference path time delay 423, which corresponds, for example, to the signal s or s(t) as described based on FIGS. 1 and 3, is provided to the difference path multiplier 421 where it is multiplied with filter coefficients 414, e.g. coefficients of a shelving filter providing a filtered difference signal $s_f$ also denoted as left path difference signal diff_L that is given to the left path summer 415 and to the right path inverter 409. The inverted filtered difference signal $-s_f$ is provided to the right path time delay 405 where it is delayed by an adjustable time delay T which is adjusted by a time delay control parameter C 412 obtaining a right path difference signal diff_R that is provided to the right path summer 413. The right path summer 413 superimposes (or sums) the right channel signal component R 404 and the right path difference signal diff_R, i.e. the delayed inverted filtered difference signal $-s_f(\tau)$ and provides a superimposed right signal $R-s_f(\tau)$ 410 to the right loudspeaker 403. The left path summer 415 superimposes (or sums) the left channel signal component L 406 and the left path difference signal diff_L, i.e. the filtered difference signal $s_f$ and provides a superimposed left signal $L+s_f$ 408 to the left loudspeaker 401. FIG. 4 represents the block diagram of the loudspeaker system 400 for an angle $\alpha \geq 0$ according to the description of FIG. 2. Thus, the loudspeaker system 400 adapts the rendering steering direction with respect to angles $\alpha \geq 0$.

In an alternative implementation not shown in FIG. 4, the right path signal inverter 409 and the right path signal delay 405 are arranged in the left path, i.e. between the output of the difference path multiplier 421 and the left path summer 415. In this implementation these functional blocks are denoted as left path signal inverter 409 and left path signal delay 405. In this implementation, the left path summer 415 superimposes (or sums) the left channel signal component L 406 and the left path difference signal diff_L, i.e. the delayed inverted filtered difference signal $-s_f(\tau)$ and provides a superimposed left signal $L-s_f(\tau)$ to the left loudspeaker 401. The right path summer 413 superimposes (or sums) the right channel signal component R 404 and the right path difference signal diff_R, i.e. the filtered difference signal $s_f$ and provides a superimposed right signal $R+s_f$ to the right loudspeaker 403. This implementation represents the block diagram of the loudspeaker system 400 for an angle $\alpha <= 0$ according to the description of FIG. 2. Thus, the loudspeaker system 400 adapts the rendering steering direction with respect to angles $\alpha <= 0$.

In a further implementation, the implementation shown in FIG. 4 where the signal inverter 409 and the signal delay 405 are arranged in the right path is combined with the alternative implementation of FIG. 4 where the signal inverter 409 and the signal delay 405 are arranged in the left path by using two switches 315, 313 according to the description with respect to FIG. 3. The left switch 315 is arranged between the difference path multiplier 421 and the left path summer 415 for providing either the filtered difference signal $s_f$ or an inverted and delayed version of the filtered difference signal $s_f$ to the left path summer 415. The right switch 313 is arranged between the difference path multiplier 421 and the right path summer 413 for providing either the filtered difference signal $s_f$ or an inverted and delayed version of the filtered difference signal $s_f$ to the right path summer 413. Both switches 315, 313 are controlled according to the description with respect to FIG. 3. Such a complete system can adapt the rendering steering direction in all directions.

The loudspeaker system 400 provides a spatial enhancement with steering towards the listener. The characteristics of such a two-loudspeaker-array enhancer with steering towards listener direction can be summed by the following items. One loudspeaker pair is used. Because of smaller form factor, i.e. only few centimeters, e.g. 5-40 cm separate the two loudspeakers, the dipole-processing of lower frequencies is not applicable. Instead, filters are used to control this aspect and the dipole processing is applied in the adapted frequency band. For the difference signal, a normal dipole rendering is used, if the listener is located straight in front of the array. For other positions of the listener, the rendering direction is adapted by changing the dipole to a tailed cardioid, such that the zero points towards the listener.

The involved signal processing is schematically shown in FIG. 4. In detail, the processing is as follows: The unmodified stereo input signal (L, R) 402 is directly given to the left path 401 and right path 403 loudspeakers to avoid timbral artifacts. The left-right difference signal (diff) is computed, filtered ($s_f$), and given with an acoustic "delay-and-subtract" process to both loudspeakers 401, 403. Depending on the listener direction, the delay $\tau$ 405 is chosen such that zero sound is emitted directly towards the listener, to enhance the spatial impression, according to the control parameter (C) indicating the steering direction. In a preferred implementation, this control parameter (C) directly uses the angle of the steering direction $\alpha$. Exemplary polar plots, for different listener directions, are shown in FIGS. 6*a*, 6*b*, 6*c* and 6*d*. The difference signal s is filtered with a filter, e.g. a low-pass shelving filter, to make up for the low-frequency gain loss of the differential sound reproduction. Low-pass filtering is also applied to mimic the spectral shape of reverberation. Exemplary frequency responses of filters applied to the loudspeaker system 400 are shown in FIG. 7 below.

Figure 5:
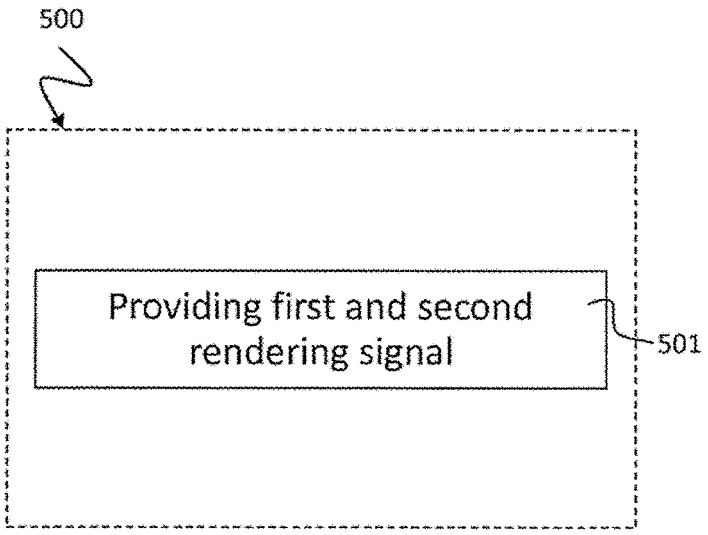
FIG. 5 shows a schematic diagram of a method 500 for rendering a stereo signal according to an implementation form.

FIG. 5 shows a schematic diagram of a method 500 for rendering a stereo signal according to an implementation form.

The method 500 is configured for rendering a stereo signal over a first and a second loudspeaker with respect to a desired direction. The stereo signal comprises a first signal component L and a second signal component R according to the description of FIG. 4. The method 500 comprises providing 501 a first rendering signal based on a combination of the first audio signal component L and a first difference signal diff_L obtained based on a difference diff between the first audio signal component L and the second audio signal component R to the first loudspeaker, and providing a second rendering signal based on a combination of the second audio signal component R and a second difference signal diff_R obtained based on the difference diff between the first audio signal component L and the second audio signal component R to the second loudspeaker, such that both difference signals diff_L, diff_R are different with respect to sign and one difference signal is delayed by a delay $\tau$ compared to the other difference signal to define a dipole signal, wherein the delay $\tau$ is adapted according to the desired direction. The first and second audio signal components L, R and the difference signals diff_L, diff_R and the delay $\tau$ correspond to the first and second audio signal components L, R and the difference signals diff_L, diff_R and the delay $\tau$ as described above with respect to FIG. 4.

In an implementation, the method 500 comprises adapting the delay $\tau$ as a function of an angle ($\alpha$) defining the desired direction relative to a central position with regard to the two loudspeakers. In an implementation, the method 500 comprises adapting the delay $\tau$ as a function of a distance d between the loudspeakers. In an implementation, the function of the angle $\alpha$ is according to: $u=\cos(\pi/2+\alpha)/(\cos(\pi/2+\alpha)-1)$, where $\alpha$ denotes the angle defining the desired direction relative to a central position with regard to the two loudspeakers and u denotes the function of the angle. In an implementation, the method 500 comprises adapting the delay $\tau$ according to: $\tau=ud/(c(1-u))$, where $\tau$ denotes the delay, d denotes the distance between the loudspeakers, u denotes the function of the angle $\alpha$ defining the desired direction relative to a central position with regard to the two loudspeakers and c denotes the speed of sound propagation. In an implementation, the method 500 comprises adapting the delay $\tau$ such that zero sound of the dipole signal is emitted towards the desired direction. In an implementation, the method 500 comprises delaying and filtering the difference diff between the first audio signal component L and the second audio signal component R prior to the combining with the first L and second R signal components; wherein further the combination of the first audio signal component L and the first difference signal diff_L comprises an addition of the first audio signal component L and the first difference signal diff_L, and the combination of the second audio signal component R and the second difference signal diff_R comprises an addition of the second audio signal component R and the second difference signal diff_R. In an implementation, the filtering comprises using a low-pass filter. In an implementation, the method 500 comprises obtaining direction information indicating the desired direction; e.g. by sensing a position of a listener; and adapting the delay $\tau$ based on the direction information. In an implementation, the distance between the loudspeakers is within a range of 5 cm and cm. In an implementation, the angle defining the desired direction relative to a central position with regard to the two loudspeakers is within a range of −90 degrees and +90 degrees. In an implementation, the angle $\alpha$ defining the desired direction relative to a central position with regard to the two loudspeakers is outside of a range between −1° and +1°, is outside of a range between −5° and +5°, or outside of a range between −10° and +10°. In an implementation, the stereo signal is available in compressed form as a parametric stereo signal comprising a mono down-mix signal and at least one inter-channel cue, in particular one of an inter-channel level difference, an inter-channel time difference, an inter-channel phase difference and an inter-channel coherence/cross correlation. In an implementation, the method 500 comprises determining the difference diff between the first audio signal component L and the second audio signal component R in frequency domain on a sub-band basis of the parametric stereo signal; and determining the delay $\tau$ by using a phase shift with respect to the sub-bands of the parametric stereo signal. In an implementation, the delay $\tau$ is adapted in a preset manner according to the desired direction.

Figure 6:
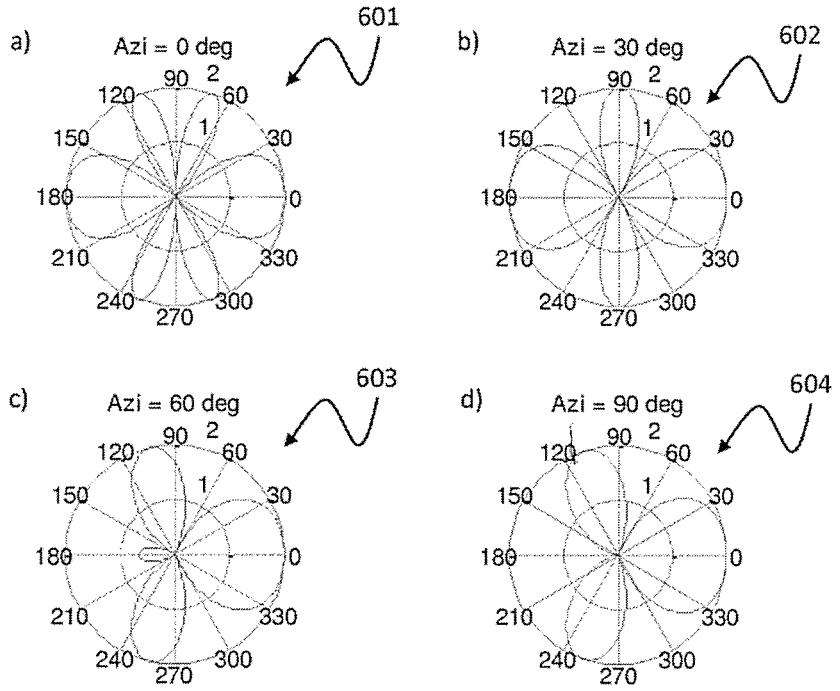
FIG. 6 shows polar plots of difference signal sound reproduction for different listener positions for the loudspeaker system 400 of FIG. 4.
Figure 7:
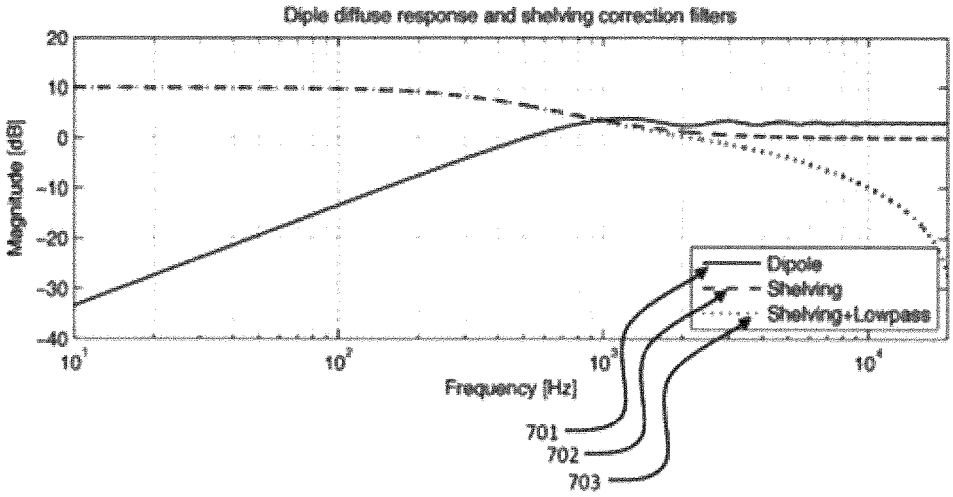
FIG. 7 shows a diagram of frequency responses of filters applied to the loudspeaker system 400 of FIG. 4 according to an implementation form.

FIG. 6 shows polar plots of a difference signal sound reproduction for different listener positions for the loudspeaker system 400 of FIG. 4, including a polar plot 601 for a direction 201 of the listener 199 according to the representation of FIGS. 1 and 2 forming an angle of $\alpha=0°$ to the zero direction 203, a polar plot 602 for a direction 201 of the listener 199 forming an angle of $\alpha=30°$ to the zero direction 203, a polar plot 603 for a direction 201 of the listener 199 forming an angle of $\alpha=60°$ to the zero direction 203, a polar plot 604 for a direction 201 of the listener 199 forming an angle of $\alpha=90°$ to the zero direction 203.

FIG. 7 shows a diagram of frequency responses of filters applied to the loudspeaker system 400 of FIG. 4 according to an implementation form. The magnitude over frequency response is depicted in FIG. 7 for a dipole 701, a shelving filter 702 and a shelving and low-pass filter 703. The low-pass shelving filter 703 compensates for the low-frequency gain loss of the differential sound reproduction. Low-pass filtering is applied to mimic the spectral shape of reverberation.

Figure 8:
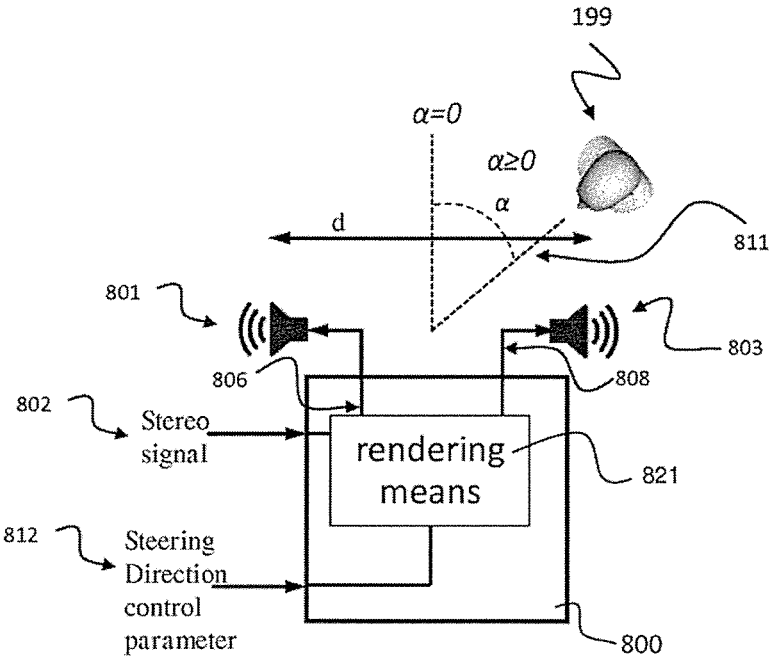
FIG. 8 shows a block diagram of a mobile device 800 configured for rendering a stereo signal according to an implementation form.

FIG. 8 shows a block diagram of a mobile device 800 configured for rendering a stereo signal according to an implementation form.

The mobile device 800 is configured for rendering a stereo signal over a first loudspeaker 801 and a second loudspeaker 803 with respect to a desired direction 811, where the stereo signal comprises a first signal component L and a second signal component R as described with respect to FIG. 4. The mobile device 800 comprises rendering means 821 which is configured for providing a first rendering signal 806 based on a combination of the first audio signal component L and a first difference signal diff_L obtained based on a difference diff between the first audio signal component L and the second audio signal component R to the first loudspeaker 801, and providing a second rendering signal 808 based on a combination of the second audio signal component R and a second difference signal diff_R obtained based on the difference diff between the first audio signal component L and the second audio signal component R to the second loudspeaker 803, such that both difference signals diff_L, diff_R are different with respect to sign and one difference signal is delayed by a delay $\tau$ compared to the other difference signal to define a dipole signal. The rendering means 821 is configured to adapt the delay $\tau$ according to the desired direction 811. The first and second audio signal components L, R and the difference signals diff_L, diff_R and the delay $\tau$ correspond to the first and second audio signal components L, R and the difference signals diff_L, diff_R and the delay $\tau$ as described above with respect to FIG. 4. In an implementation, the mobile device 800 comprises sensing means, for example a camera, configured for sensing positioning information C of a listener 199 listening to the stereo signal 802, wherein the rendering means 821 is configured to adapt the delay $\tau$ based on the positioning information C.

The loudspeakers 801, 803 are conventional loudspeakers, i.e. no special hardware for implementing dipole loudspeakers is required.

In an implementation, the input stereo signal 802 is composed of the two channels L and R. In another implementation, the input stereo signal 802 is composed of a parametric representation of the stereo signal, e.g. a compressed stereo signal based on a coding/decoding scheme. In an implementation, this coding/decoding scheme uses a parametric representation of the stereo signal known as "Binaural Cue Coding" (BCC), which is presented in details in "Parametric Coding of Spatial Audio," C. Faller, Ph.D. Thesis No. 3062, Ecole Polytechnique Fédérale de Lausanne (EPFL), 2004. In this document, a parametric spatial audio coding scheme is described. This scheme is based on the extraction and the coding of inter-channel cues that are relevant for the perception of the auditory spatial image and the coding of a mono or stereo representation of the multichannel audio signal. The inter-channel cues are Interchannel Level Difference (ILD) also known as Channel Level Difference (CLD), Interchannel Time Difference (ITD) which can also be represented with Interchannel Phase Difference (IPD), and Interchannel Coherence/Cross Correlation (ICC). The inter-channel cues are generally extracted based on a sub-band representation of the input signal (e.g. using a conventional Short-Time Fourier Transform (STFT) or a Complex-modulated Quadrature Mirror Filter (QMF)). The sub-bands are grouped in parameter bands following a non-uniform frequency resolution which mimic the frequency resolution of the human auditory system. The mono or stereo downmix signal is obtained by matrixing the original multichannel audio signal. This downmix signal is then encoded using conventional state-of-the-art mono or stereo audio coders. In this embodiment, the mono downmix signal is received by the mobile device 800 together with the stereo parameters (CLD, ITD and ICC).

A mono-downmix signal may be a combination of left and right channel signal. A mono-downmix signal may comprise inter-channel cues for both left and right channel per sub-band. A mono-downmix signal may be only the left or right channel signal. The inter-channel cues may be used only for the other channel per sub-band.

The steering direction rendering is then embedded in the parametric stereo synthesis. Thus, the computation of the difference signal is performed in the frequency domain on a sub-band basis, based on the sub-band stereo synthesis. In an implementation, the delay is easily introduced by using a sub-band phase shift and the filter is advantageously applied using different gains for each sub-band.

In an implementation, the steering direction control parameter 812 is obtained from an external tracking system or built-in in device. In an implementation, the angle $\alpha$ is a predetermined parameter stored in memory to a have a fixed steering direction. In an alternative implementation, the angle $\alpha$ is dynamically adjustable and obtained from a head tracking system or directly controlled by the user with a graphical interface.

In an implementation, the mobile device 800 is a docking station. In an implementation, the loudspeakers are external to the mobile device 800. In an implementation the mobile device 800 is a smartphone, a tablet or a laptop with built-in loudspeakers.

FIG. 9 shows a block diagram of a loudspeaker system 900 according to an implementation form.

The loudspeaker system 900 comprises a left path loudspeaker 901, a right path loudspeaker 903, a right path time delay 905, a right path signal inverter 909, a right path summer 913, a left path summer 915, a difference path summer 925, an optional difference path time delay 923, a difference path multiplier 921, a left path downmix multiplier 955 and a right path downmix multiplier 953. The loudspeakers 901, 903 are conventional loudspeakers, i.e. no special hardware for implementing dipole loudspeakers is required.

As illustrated in FIG. 9, a parametric stereo signal 902 with first parameter $c_1$ 904, e.g. an inter-channel cue and second parameter $c_2$ 906, e.g. a further inter-channel cue is input to the loudspeaker system 900. The first parameter $c_1$ 904 is given to the right path summer 913 and to the difference path summer 925, the second parameter $c_2$ 906 is given to the left path summer 915 and the inverted second parameter $c_2$ 906 is given to the difference path summer 925. The difference path summer 925 subtracts the second parameter $c_2$ 906 from the first parameter $c_1$ 904 providing a difference or a difference signal diff to the optional difference path time delay 923. In an implementation including the optional difference path time delay 923, the output signal s, which corresponds, for example, to the signal s or s(t) as described based on FIGS. 1 and 3, of the optional difference path time delay 923 or of the summer 925 is given as left path difference signal diff_L to the left path summer 915 and to the right path inverter 909. In an alternative implementation not including the optional difference path time delay 923, the difference signal diff is given as left path difference signal diff_L to the left path summer 915 and to the right path inverter 909. The inverted left path difference signal diff_L is provided to the right path time delay 905 where it is delayed by an adjustable or adjusted time delay $\tau$, which is for instance adjusted by a time delay control parameter C 912, for obtaining a right path difference signal diff_R which is provided to the right path summer 913. The right path summer 913 superimposes (or sums) the first parameter $c_1$ 904 and the right path difference signal diff_R and provides a right path sum signal to the right path downmix multiplier 953 where the right path sum signal is multiplied with the downmix signal 950 and provided as right signal $R-s_f(\tau)$ 910 to the right loudspeaker 903. The left path summer 915 superimposes (or sums) the second parameter $c_2$ 906 and the left path difference signal diff_L and provides a left path sum signal to the left path downmix multiplier 955 where the left path sum signal is multiplied with the downmix signal 950 and provided as left signal $L+s_f$ 908 to the left loudspeaker 901. FIG. 9 represents the block diagram of the loudspeaker system 900 for an angle $\alpha \geq 0$ according to the description of FIG. 2. Thus, the loudspeaker system 900 adapts the rendering steering direction with respect to angles $\alpha \geq 0$.

In an alternative implementation not shown in FIG. 9, the right path signal inverter 909 and the right path signal delay 905 are arranged instead in the left path, i.e. between the output of the optional difference path multiplier 921 and the left path summer 915. In this implementation these functional blocks are denoted as left path signal inverter 909 and left path signal delay 905. In this implementation, the left path summer 915 superimposes (or sums) the second parameter $c_2$ 906 and the delayed inverted left path difference signal diff_L and provides a superimposed left signal $L-s_f(\tau)$ to the left loudspeaker 901. The right path summer 913 superimposes (or sums) the first parameter $c_1$ 904 and the right path difference signal diff_R and provides a superimposed right signal $R+s_f$ to the right loudspeaker 903. This implementation represents the block diagram of the loudspeaker system 900 for an angle $\alpha <= 0$ according to the description of FIG. 2. Thus, the loudspeaker system 900 adapts the rendering steering direction with respect to angles $\alpha <= 0$.

In a further implementation, the implementation shown in FIG. 9 where the signal inverter 909 and the signal delay 905 are arranged in the right path is combined with the alternative implementation of FIG. 9 where the signal inverter 909 and the signal delay 905 are arranged in the left path by using two switches 315, 313 according to the description with respect to FIG. 3. The left switch 315 is arranged between the difference path time delay 923 and the left path summer 915 for providing either the left path difference signal diff_L or an inverted and delayed version thereof to the left path summer 915. The right switch 313 is arranged between the difference path time delay 923 and the right path summer 913 for providing either the right path difference signal diff_R an inverted and delayed version thereof to the right path summer 913. Both switches 315, 313 are controlled according to the description with respect to FIG. 3. Such a complete system can adapt the rendering steering direction in all directions.

From the foregoing, it will be apparent to those skilled in the art that a variety of methods, systems, computer programs on recording media, and the like, are provided.

The present disclosure also supports a computer program product including computer executable code or computer executable instructions that, when executed, causes at least one computer to execute the performing and computing steps described herein.

Many alternatives, modifications, and variations will be apparent to those skilled in the art in light of the above teachings. Of course, those skilled in the art readily recognize that there are numerous applications of the invention beyond those described herein. While the present inventions has been described with reference to one or more particular embodiments, those skilled in the art recognize that many changes may be made thereto without departing from the scope of the present invention. It is therefore to be understood that within the scope of the appended claims and their equivalents, the inventions may be practiced otherwise than as specifically described herein.

What is claimed is:

1. A method for rendering a stereo audio signal over a first loudspeaker and a second loudspeaker with respect to a desired direction, the stereo audio signal comprising a first audio signal component (L) and a second audio signal component (R), the method comprising:

providing a first rendering signal based on a combination of the first audio signal component (L) and a first difference signal (diff_L) obtained based on a difference (diff) between the first audio signal component (L) and the second audio signal component (R) to the first loudspeaker;

providing a second rendering signal based on a combination of the second audio signal component (R) and a second difference signal (diff_R) obtained based on the difference (diff) between the first audio signal component (L) and the second audio signal component (R) to the second loudspeaker, wherein both difference signals (diff_L, diff_R) are different with respect to sign and one difference signal is delayed by a delay ($\tau$) compared to the other difference signal to define a dipole signal, wherein the delay ($\tau$) is adapted according to the desired direction; and adapting the delay ($\tau$) such that zero sound of the dipole signal is emitted towards the desired direction.

2. The method of claim 1, comprising:

adapting the delay ($\tau$) as a function of an angle ($\alpha$) defining the desired direction relative to a central position with regard to the two loudspeakers.

3. The method of claim 2, comprising:

adapting the delay ($\tau$) as a function of a distance (d) between the loudspeakers.

4. The method of claim 3, wherein the function of the angle (a) is according to:

$$u=\cos(\pi/2+\alpha)/(\cos(\pi/2+\alpha)-1),$$

where $\alpha$ denotes the angle defining the desired direction relative to a central position with regard to the two loudspeakers and u denotes the function of the angle.

5. The method of claim 4, comprising:

adapting the delay ($\tau$) according to:

$$\tau=ud/(c(1-u)),$$

where $\tau$ denotes the delay, d denotes the distance between the loudspeakers, u denotes the function of the angle ($\alpha$) defining the desired direction relative to a central position with regard to the two loudspeakers and c denotes the speed of sound propagation.

6. The method of claim 1, comprising:

delaying and filtering the difference (diff) between the first audio signal component (L) and the second audio signal component (R) prior to the combining with the first (L) and second (R) signal components;

the combination of the first audio signal component (L) and the first difference signal (diff_L) comprises an addition of the first audio signal component (L) and the first difference signal (diff_L); and the combination of the second audio signal component (R) and the second difference signal (diff_R) comprises an addition of the second audio signal component (R) and the second difference signal (diff_R).

7. The method of claim 6, wherein filtering comprises using a low-pass filter.

8. The method of claim 1, comprising:

obtaining a direction information indicating the desired direction, in particular by sensing a position of a listener; and adapting the delay (τ) based on the direction information.

9. The method of claim 1, wherein the distance (d) between the loudspeakers is within a range of 5 cm and 40 cm.

10. The method of claim 1, wherein the angle (α) defining the desired direction relative to a central position with regard to the two loudspeakers is within a range of −90 degrees and +90 degrees.

11. A method for rendering a stereo audio signal over a first loudspeaker and a second loudspeaker with respect to a desired direction, the stereo audio signal comprising a first audio signal component and a second audio signal component, the method comprising:

providing a first rendering signal based on a combination of the first audio signal component and a first difference signal obtained based on a difference between the first audio signal component and the second audio signal component to the first loudspeaker; and providing a second rendering signal based on a combination of the second audio signal component and a second difference signal obtained based on the difference between the first audio signal component and the second audio signal component to the second loudspeaker, wherein both difference signals are different with respect to sign and one difference signal is delayed by a delay compared to the other difference signal to define a dipole signal, wherein the delay is adapted according to the desired direction;

wherein the stereo audio signal is in compressed form as a parametric stereo signal comprising a mono downmix signal and at least one inter-channel cue, in particular one of an inter-channel level difference, an inter-channel time difference, an inter-channel phase difference and an inter-channel coherence/cross correlation.

12. The method of claim 11, comprising:

determining the difference between the first audio signal component and the second audio signal component in frequency domain on a sub-band basis of the parametric stereo signal; and determining the delay by using a phase shift with respect to the sub-bands of the parametric stereo signal.

13. A mobile device configured for rendering a stereo audio signal over a first loudspeaker and a second loudspeaker with respect to a desired direction, the stereo audio signal comprising a first audio signal component (L) and a second audio signal component (R), the mobile device comprising:

a processor; and memory coupled to the processor, the memory comprising instructions that, when executed by the processor, cause the mobile device to:

provide a first rendering signal based on a combination of the first audio signal component (L) and a first difference signal (diff_L) obtained based on a difference (diff) between the first audio signal component (L) and the second audio signal component (R) to the first loudspeaker;

provide a second rendering signal based on a combination of the second audio signal component (R) and a second difference signal (diff_R) obtained based on the difference (diff) between the first audio signal component (L) and the second audio signal component (R) to the second loudspeaker, wherein both difference signals (diff_L, diff_R) are different with respect to sign and one difference signal is delayed by a delay (τ) compared to the other difference signal to define a dipole signal, wherein the rendering means is configured to adapt the delay (τ) according to the desired direction; and adapt the delay (τ) such that zero sound of the dipole signal is emitted towards the desired direction.

14. The mobile device of claim 13, comprising:

a camera configured to sense positioning information (C) of a listener listening to the stereo signal; and wherein the memory further comprises instructions that, when executed by the processor, cause the mobile device to adapt the delay (τ) based on the positioning information (C).

15. A method for rendering a stereo audio signal over a first loudspeaker and a second loudspeaker with respect to a desired direction, the stereo audio signal comprising a first audio signal component (L) and a second audio signal component (R), the method comprising:

providing a first rendering signal based on a combination of the first audio signal component (L) and a first difference signal (diff_L) obtained based on a difference (diff) between the first audio signal component (L) and the second audio signal component (R) to the first loudspeaker;

providing a second rendering signal based on a combination of the second audio signal component (R) and a second difference signal (diff_R) obtained based on the difference (diff) between the first audio signal component (L) and the second audio signal component (R) to the second loudspeaker, wherein both difference signals (diff_L, diff_R) are different with respect to sign and one difference signal is delayed by a delay (τ) compared to the other difference signal to define a dipole signal, wherein the delay (τ) is adapted according to the desired direction;

adapting the delay (τ) as a function of an angle (α) defining the desired direction relative to a central position with regard to the two loudspeakers; and adapting the delay (τ) as a function of a distance (d) between the loudspeakers;

wherein the function of the angle (α) is according to:

$$u=\cos(\pi/2+\alpha)/(\cos(\pi/2+\alpha)-1),$$

where α denotes the angle defining the desired direction relative to a central position with regard to the two loudspeakers and u denotes the function of the angle.

16. A mobile device configured for rendering a stereo audio signal over a first loudspeaker and a second loudspeaker with respect to a desired direction, the stereo audio signal comprising a first audio signal component (L) and a second audio signal component (R), the mobile device comprising:

a processor; and memory coupled to the processor, the memory comprising instructions that, when executed by the processor, cause the mobile device to:

provide a first rendering signal based on a combination of the first audio signal component (L) and a first difference signal (diff_L) obtained based on a difference (diff) between the first audio signal component (L) and the second audio signal component (R) to the first loudspeaker;

provide a second rendering signal based on a combination of the second audio signal component (R) and a second difference signal (diff_R) obtained based on the difference (diff) between the first audio signal component (L) and the second audio signal component (R) to the second loudspeaker, wherein both difference signals (diff_L, diff_R) are different with respect to sign and one difference signal is delayed by a delay ($\tau$) compared to the other difference signal to define a dipole signal, wherein the rendering means is configured to adapt the delay ($\tau$) according to the desired direction;

adapt the delay ($\tau$) as a function of an angle ($\alpha$) defining the desired direction relative to a central position with regard to the two loudspeakers; and adapt the delay ($\tau$) as a function of a distance (d) between the loudspeakers;

wherein the function of the angle ($\alpha$) is according to:

$$u=\cos(\pi/2+\alpha)/(\cos(\pi/2+\alpha)-1),$$

where $\alpha$ denotes the angle defining the desired direction relative to a central position with regard to the two loudspeakers and u denotes the function of the angle.

* * * * *